US005785794A

United States Patent [19]

Fiedler

[11] Patent Number: 5,785,794

[45] Date of Patent: Jul. 28, 1998

[54] SEAL ROLL INDEX

[75] Inventor: Lee B. Fiedler, Denmark, Wis.

[73] Assignee: FMC Corporation, Chicago, Ill.

[21] Appl. No.: 810,874

[22] Filed: Mar. 5, 1997

[51] Int. Cl.[6] ..... B31B 1/10; B31B 23/00

[52] U.S. Cl. ..... 156/290; 156/308.4; 156/538; 156/553; 156/583.1; 493/193; 493/196; 493/267

[58] Field of Search ..... 156/251, 290, 156/308.2, 308.4, 538, 553, 580, 583.1; 493/189, 193, 196, 203, 204, 267; 53/453, 559

[56] References Cited

U.S. PATENT DOCUMENTS

| | | | |
|---|---|---|---|
| 4,192,705 | 3/1980 | Wech | 156/515 |
| 4,261,779 | 4/1981 | Wech | 156/251 |
| 4,451,249 | 5/1984 | DeBin | 493/204 |
| 4,573,955 | 3/1986 | Mory et al. | 493/204 |
| 4,735,602 | 4/1988 | DeBin | 493/204 |
| 5,000,727 | 3/1991 | Hatchell et al. | 493/193 |
| 5,094,656 | 3/1992 | Hatchell et al. | 493/193 |
| 5,170,611 | 12/1992 | Buchko et al. | 53/453 |
| 5,230,688 | 7/1993 | Hatchell et al. | 493/193 |
| 5,338,281 | 8/1994 | Terranova | 493/28 |
| 5,647,832 | 7/1997 | Nickell et al. | 493/84 |

*Primary Examiner*—James Sells
*Attorney, Agent, or Firm*—Rockey, Milnamow & Katz, Ltd.

[57] ABSTRACT

An apparatus for indexing a seal roll which is engagable by a heat seal head to prevent the contact area of said heat seal head from successive landing at the same location on the seal roll includes a driven pulley mounted coaxially with the seal roll and components for indexing to turn the driven pulley. The components include a rocker mounted on a common axis with a drive pulley via a one-way clutch and an actuator connected eccentrically to the rocker such that reciprocating motion of the actuator rotates the rocker in opposite directions. In one direction, the rocker rotates the drive pulley via the one-way clutch to index the roll via the drive belt and driven pulley. In an opposite direction, the clutch permits rotation of the rocker in the opposite direction free of rotation of the drive pulley. A brake member is connected to the rocker eccentrically of the common axis, the brake member clamping the drive belt against a stop member for seizing rotation of the roll during the heat seal procedure.

13 Claims, 3 Drawing Sheets

FIG. 3
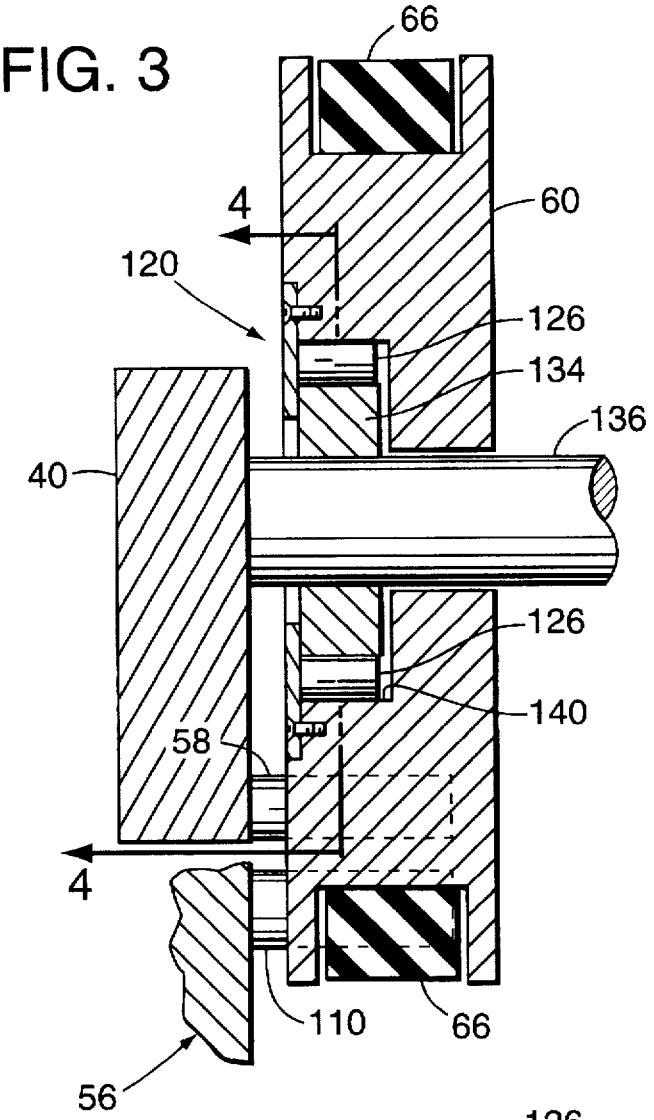
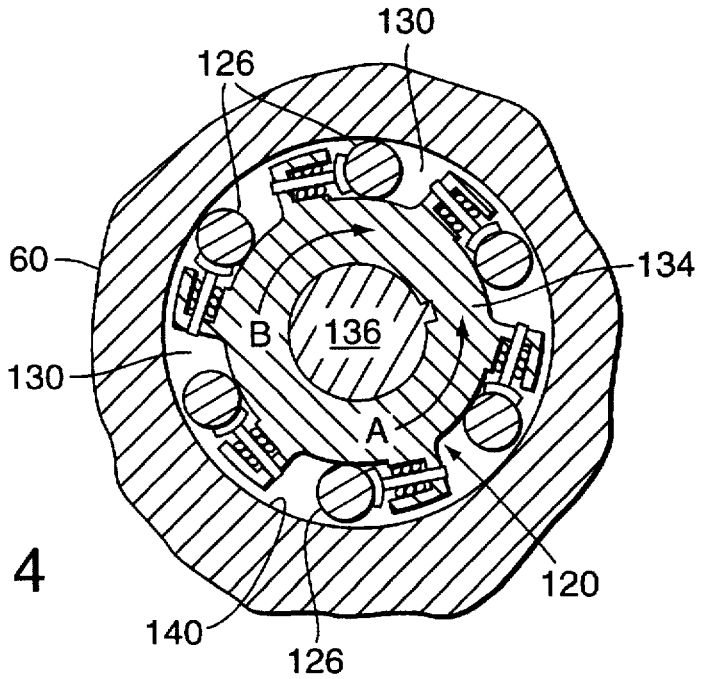
FIG. 4

SEAL ROLL INDEX

FIELD OF THE INVENTION

The present invention relates to heat sealing equipment, and particularly to heat sealing equipment for sealing tube stock to form bags, including a dual acting air cylinder which effects braking and indexing of a seal roll operatively associated with a reciprocating heat seal head.

BACKGROUND OF THE INVENTION

Plastic bags can be formed, or sealed by transporting an elongate web of bag stock through a heat sealing station and intermittently sealing the tubular stock across a width thereof. The heat sealing station includes a reciprocating heat seal head which is brought into pressing contact with the tubular stock supported on a seal roll. It is known to intermittently rotate the seal roll to provide a cooled landing surface area on the seal roll for the heat seal head for heat sealing each intermittent heat seal region across the width of the tubular stock.

According to present technology, a main servo-drive rotates coacting draw rolls to translate tube stock through a heat seal station, including the heat seal head and cooperating seal roll, which main servo drive also drives a gear train to drive the seal roll. The gear train is a maintenance concern and the additional load on the main servo-drive limits the speed of the servo drive. Also, backlash in the gear train can adversely affect the quality of the heat seals. The backlash allows the seal roll to float when the seal head comes into contact therewith.

Also known is an indexing device which uses an overrunning clutch on the seal roll. The device uses two bands tensioned with springs, one for indexing and one for braking. The braking mechanism is always engaged and is overcome by the indexing band. An oscillating shaft is used to provide the linear motion to pull on the indexing band to rotate the seal roll.

A similar device is known which relocates the overrunning clutch from the seal roll to mount to an intermediate shaft that is geared to the seal roll. Also known is the use of a cam instead of the oscillating shaft to provide the linear motion to pull on the indexing band and to rotate the seal roll.

SUMMARY OF THE INVENTION

The present invention provides a dual-acting, air cylinder to be used as a power source to rotate, stop and then hold a seal roll in position during a sealing operation. The linear movement of the air cylinder is converted into rotary motion with the use of a rocker. This rocker is connected to a drive pulley through an overrunning clutch and bearing. The drive pulley rotates the seal roll with a flexible drive belt. The overrunning clutch allows the rocker to rotate the drive pulley in only a first direction. When the rocker is rotated in a second direction, the rocker is used to brake the belt.

The device of the present invention has two modes of operation: braking and indexing. In the braking mode of operation, positive air pressure is supplied to one side of an air cylinder while the other side is open to the atmosphere, causing a piston within the air cylinder to move to retract an output shaft. When the piston is retracted, the flexible drive belt is pinched between the rocker and a stop. When the belt is pinched, i.e., the brake is actuated, the belt and the seal roll are positively stopped and restrained from any movement.

After a sealing operation is completed and a signal is given to index, the air pressure inputs to the cylinder are reversed, causing the piston within the air cylinder to extend the output shaft and the rocker to rotate in the first direction. The rotation of the rocker simultaneously releases the brake and rotates the drive pulley in the first direction via the overrunning clutch. Consequently, the drive pulley rotates the seal roll via the flexible belt. Since the drive pulley is mounted on the overrunning clutch, the seal roll and drive pulley are free to rotate in the direction of the index. In order to stop the seal roll from overrunning after an index, the brake is reapplied by reversing the air pressure to the cylinder and rotating the rocker in the second direction. The brake remains engaged through the sealing cycle until a signal is given for another index movement. The amount of movement of the index is determined by the amount of the time that the air pressure is switched.

Holding the seal roll stationary during heat sealing by use of the brake allows for a more precise and effective heat seal compared to prior art apparatus which allow some movement of the seal roll during heat sealing. The seal roll index apparatus of the present invention effectively separates the seal roll index driving mechanism from the main servo drive. Thus the problems associated with driving the heat seal roll index using a gear train driven by the main servo drive is eliminated by the independent seal roll index drive of the present invention.

Other features and advantages of the present invention will become readily apparent from the following detailed description of the accompanying drawings, and the appended claims.

BRIEF DESCRIPTION OF THE DRAWINGS

FIG. 3 is a diagrammatic sectional view taken generally along line 3—3 in FIG. 1; and FIG. 4 is a diagrammatic sectional view taken generally along line 4—4 in FIG. 3.

DETAILED DESCRIPTION OF THE PREFERRED EMBODIMENTS

Figure 1:
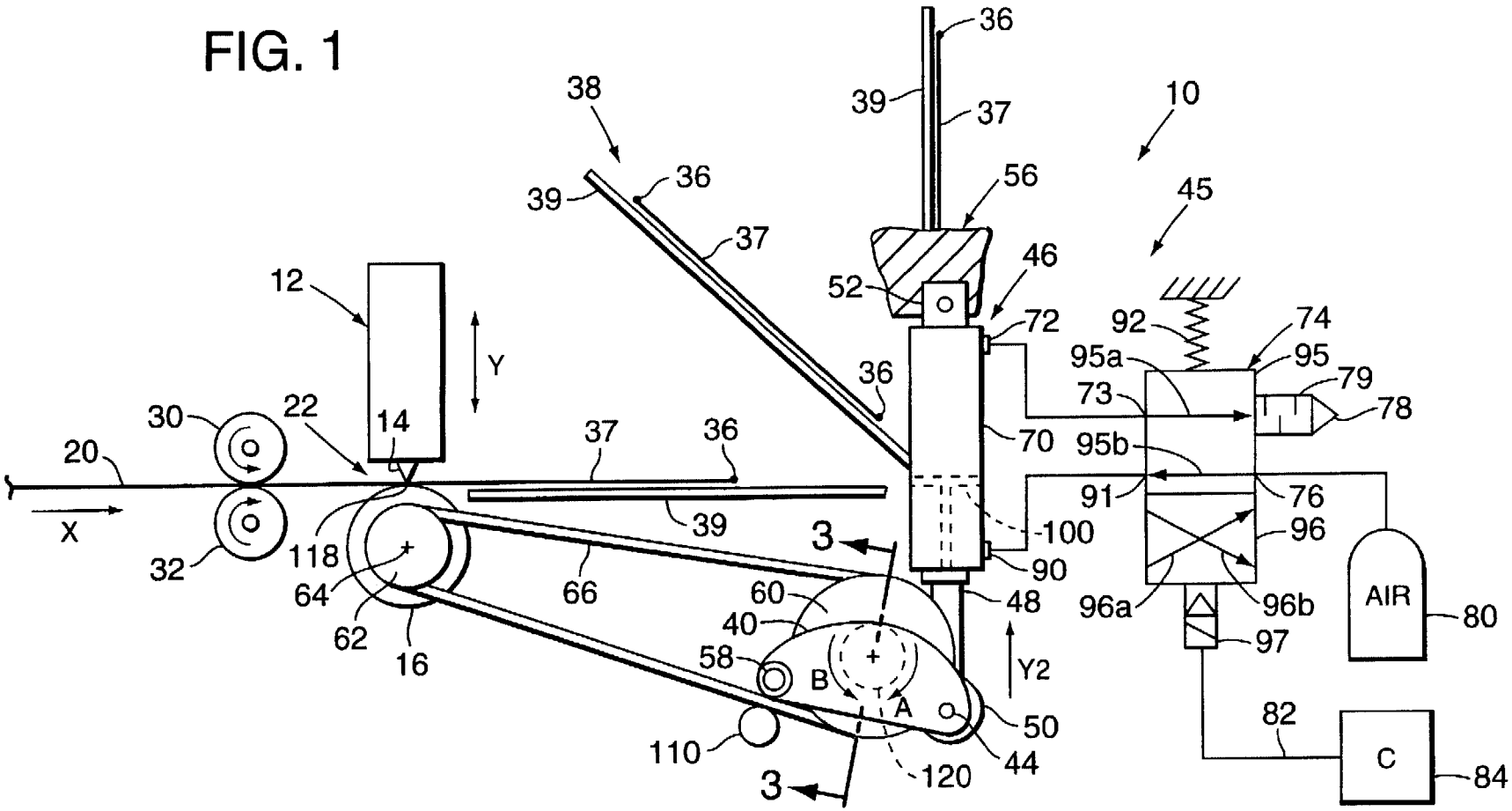
FIG. 1 is a diagrammatic elevational view of the apparatus of the present invention in a first mode of operation.

While the present invention is susceptible of embodiment in various forms, there is shown in the drawings and will hereinafter be described presently preferred embodiments with the understanding that the present disclosure is to be considered an exemplification of the invention and is not intended to limit the invention to the specific embodiments illustrated.

FIG. 1 illustrates a bag sealing apparatus 10 of the present invention. The sealing apparatus includes a heat sealing mechanism 12 having a heat sealing head 14 in opposition to a seal roll 16. The head is heated and composed of metal, the seal roll is composed of rubber coated steel and covered with Teflon tape.

Once folded, plastic bag stock 20, having a folded longitudinal edge and an open longitudinal edge and arranged in a folded flat configuration, is progressed through the heat sealing region 22 by draw rollers 30, 32 of a servo drive. The draw rollers 30, 32 are located close to and upstream of the heat seal region 22. The heat sealing mechanism 12 is reciprocatable along the direction Y downwardly to cause the heat sealing head 14 to press the bag stock 20 to the seal roll 16 to effect a heat seal 36 across the width of the bag stock 20 and intermittently along the length of the bag stock 20; and upwardly to allow the bag stock to be moved by the roller 30, 32 along the direction X.

The heat seals 36 close lateral edges of individual bags 37 which are separated by the action of the heat seal head 14 from the bag stock 20. Thus each bag 37 is closed on three sides by a lengthwise fold of the bag stock 20 (not shown) and two heat seals 36.

A rotating wicketer 38 receives the bags 37 successively from the heat seal region 22 on revolving arms 39 which hold the bags 37 by vacuum and deliver the bags 37 to a further station or conveyor (not shown).

A rocker 40 is provided pivoted about a center axis 42. The rocker 40 in FIG. 1 is shaped in the form of a segment of a circle. The rocker 40 pivots about a pivot connection 44 to a pneumatic linear positioner 45 including an air cylinder actuator 46. The actuator includes an extendable shaft 48 connected to a round lug 50 at the pivot connection 44. The actuator 46 is pin-connected at a top lug 52 to stationary support structure 56.

At an opposite end of the rocker 40 from the pivot connection 44 is a brake roller 58 pinned to the rocker 40. A drive pulley 60 is mounted flushly to the rocker 40 and having the same axis of rotation 42. Mounted at an axial end of the seal roll 16 is a driven roll pulley 62. The roll pulley 62 is fixed for rotation with the seal roll 16 about an axis 64. A drive belt 66 is wound around the drive pulley 60 and the roll pulley 62. Hence, forcible rotation of the drive pulley 60 causes a corresponding rotation of the roll pulley 62.

The belt can be a standard neoprene backed belt, or a polyurethane belt if belt wear is excessive.

The actuator 46 includes a tubular pneumatic cylinder 70 having a first pneumatic port 72 connected to a first port 73 of a four-way pneumatic valve 74 having an air supply inlet 76, tube connected to compressed air 80, and an air bleed to atmosphere 78 through a muffler 79. A second pneumatic port 90 into the cylinder 70 is tube connected to a second port 91 of the four-way valve 74. Compressed air 80 can thus be supplied into the cylinder 70 depending on a control signal 82 from a controller 84. In the configuration illustrated the signal 82 is a zero signal, or no signal. The controller 84 can be an electronic controller or can simply be a synchronized signal from a timer, roller, gear or other repeated synchronized signal.

The four-way valve is urged by a spring 92 to the configuration shown in FIG. 1. The valve 74 includes a first valve block 95 having straight through channels 95*a*, 95*b*, and a second valve block 96 having crossed channels 96*a*, 96*b*. The valve has a solenoid actuator 97 which when activated moves the blocks 95, 96 toward the spring 92, to compress the spring, and assume the configuration shown in FIG. 2.

In the configuration shown in FIG. 1, the ports 73, 91 are connected to channels 95*a*, 95*b* which are connected to the muffler 79 and air supply inlet 76 respectively. When changed to the configuration of FIG. 2, the port 73 is connected to the air supply inlet 76 through the cross channel 96*b* and the port 91 is connected to the muffler 79 through the cross channel 96*a*. To switch from the configuration of the valve 74 illustrated in FIG. 1 to that shown in FIG. 2 a signal 98 is sent from the controller 84 to the solenoid actuator 97.

Adjacent the brake roller 58 is a stop 110 which is located on an outside of the belt 66 in close proximity thereto. The stop 110 can be a stationary abutment or a roller.

When the rocker 40 is pivoted an angular amount in a counterclockwise direction by movement of the shaft 48 in the direction Y2, the brake roller 58 squeezes the belt 66 against the stop 110 to cause an immediate braking of the belt 66. In the position shown in FIG. 1, the belt 66 is braked and the heat seal tool 12 has been lowered in the direction Y so that the seal head 14 has pressed the bag stock 20 downwardly onto the seal roll 16 to effect a heat seal 36 in the region 22. The bag stock 20 is also cut or separated by the seal head 14 defining the separate bags 37 thereby.

Figure 2:
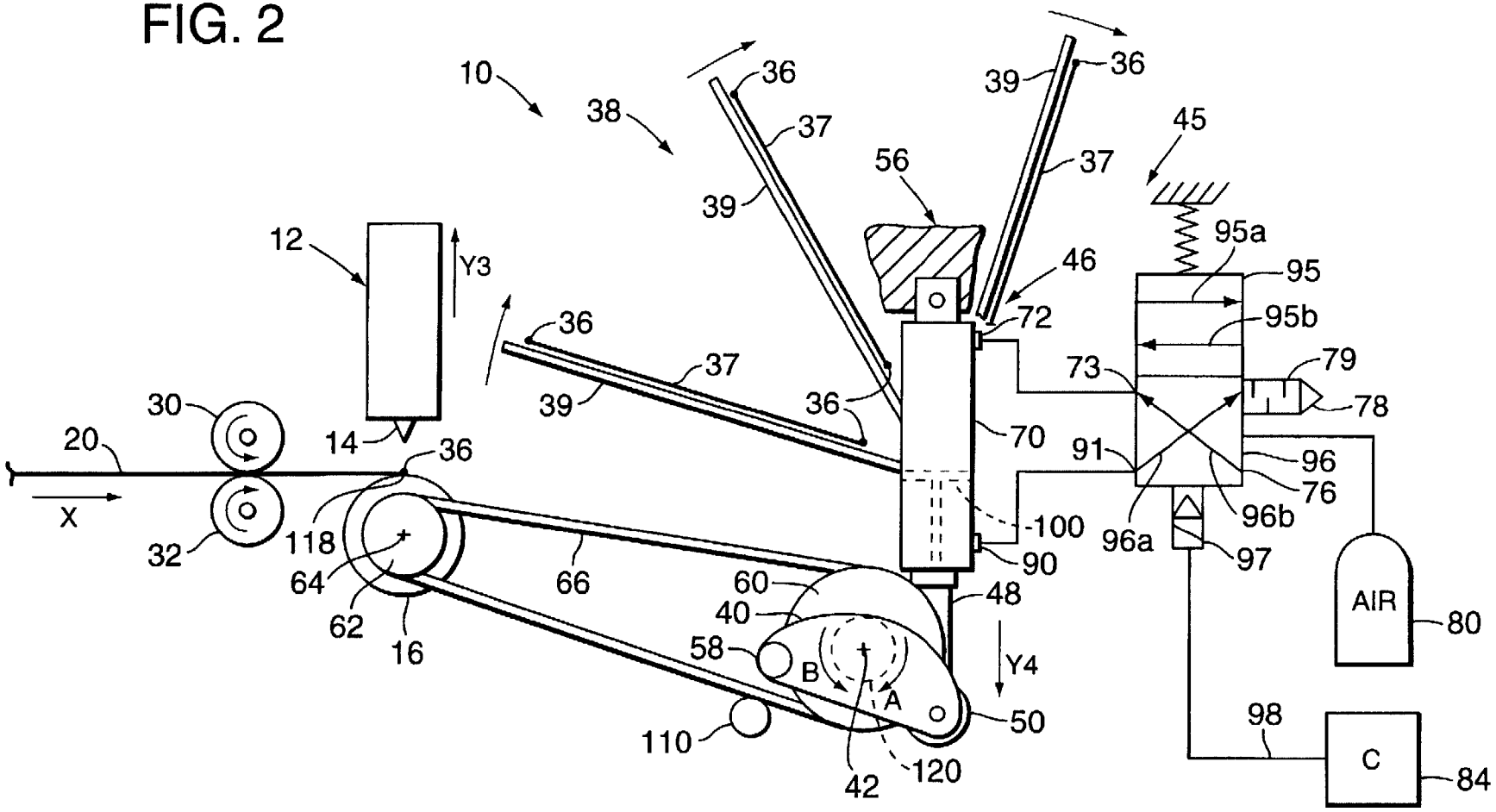
FIG. 2 is a diagrammatic elevational view of the apparatus of FIG. 1 in a second mode of operation.

FIG. 2 illustrates the apparatus 10 in an indexing mode. That is, the seal head 14 has been retracted from the seal roll 16 by lifting the seal tool 12 in the vertical direction Y3. The bag stock 20 has been indexed a distance downstream (to the right) by the rollers 30, 32. The controller 84 has sent a signal 98 to shift the valve block 95 away from the ports 73, 91, and to shift the valve block to the ports 73, 91 to register therewith. Compressed air is sent through the first pneumatic port 72 to an upper region within the cylinder 70. At the same time, the air in a lower region of the cylinder can exit the port 90 and discharge to atmosphere through the muffler 79 and the exhaust outlet 78. Thus, compressed air forces a piston 100 disposed within the cylinder to depress the shaft 48 in the direction Y4 to pivot the rocker 40 clockwise to release the brake roll 58 from the stop 110 and at the same time to turn the drive pulley 60 clockwise a preselected amount. Accordingly, the belt 66 is driven by the drive pulley 60 to rotate the roll pulley 62 and thus the seal roll 16 by a preselected angular amount. Thus, an indexing of the roll 16 has been accomplished so that the equipment can next return to the condition shown in FIG. 1 and the heat seal head 14 can be descended upon the roll 16 at a new location around the circumference of the roll 16. Because the roll 16 has been rotated, the landing line 118 of the heat seal head 14 on the roll 16 is different for successive heat seals. The preceding landing line on the roll is thus allowed to cool before eventually being positioned beneath the heat seal head again, and a heat build up, and high localized temperature, at the landing line 118 is avoided.

Because the landing line 118 is thus frequently changed on the seal roll, excessive wear at any one location is avoided. Also, advantageously, the belt 66 is a non-synchronous belt, that is the belt is toothless, and a small amount of slippage or float occurs between the belt and the associated pulleys 60, 62 during circulation. This effectively further changes the exact landing line location on the seal roll, introducing some degrees of randomness, so that an exact landing line 118 is not repeatedly used during indexing over a period of time. This achieves a more even wear of the seal roll 16.

To return to the position of FIG. 1, the controller sends the signal 82 to the four-way valve 74 to deactivate the solenoid actuator 97. Under influence of the spring 92, block 96 shifts away from the ports 73, 91 and block 95 shifts to the ports 73, 91 to register therewith. Pressurized air 80 is admitted to a lower region of the cylinder 70 via the channel 95*b* and the second pneumatic port 90. At the same time, air is exhausted from an upper region of the cylinder 70 through the port 72, the channel 95*a* and the muffler 79. The piston 100 within the cylinder 70 will then be raised in the direction Y2 as shown in FIG. 1, and the apparatus is shifted to the braking position shown in FIG. 1, ready for another heat seal to be applied to the bag stock.

An overrunning clutch 120 is arranged between the rocker 40 and the drive pulley 60. Overrunning clutches are well known and are available in varying styles as understood by one skilled in the art. The overrunning clutches as shown in FIGS. 3 and 4 includes a plurality of spring-loaded rollers 126 within contoured wedge spaces 130 formed around a clutch plate 134. The clutch plate 134 is connected by a keyed shaft 136 to the rocker 40. The shaft 136 is keyed both to the clutch plate 134 and to the rocker 40 to ensure mutual rotation between the two parts.

As shown in FIGS. 2 and 4 when the rocker 40 is turned in the rotary direction A via the shaft 136, the clutch plate 134 is turned in the direction A and the rollers 126 engage tightly within the recesses 130 and an inside circumferential surface 140 of the drive pulley 60. The clutch plate 134 thus engages the drive pulley 60 for rotation therewith. The rocker 40 and the drive pulley 60 thus rotate together clockwise as seen in FIG. 2.

When the rocker 40 is rotated in the rotary direction B as shown in FIG. 1, the rollers 126 disengage from the inside surface 140 of the drive pulley 60 and the rocker rotates in the direction B alone, without driving the drive pulley 60.

It thus follows that up and down movement of the shaft 48 of the pneumatic actuator 46 accomplishes two functions, that is, to engage a braking action between the brake roll 58 and the stop 110 and when returned to the position shown in FIG. 2, by rotation in the direction A, to turn the drive pulley 60 to cause an indexing of the seal roll 16. Thus, when the heat seal head 14 returns downwardly to press the bag stock 20 against the seal roll, a new landing location is presented.

The speed and angular displacement, or index amount, of the seal roll is determined by the pressure and duration of the air supply to the cylinder 70. For bag making operation, a pressure of 50 psig and a start signal 98 at 325° and an ending signal 82 at 355° are advantageous. The degrees are relative to the rotation of the wicketer arm 39 being horizontally disposed beneath the bag 37 at 360° (or 0°) and rotated clockwise in FIG. 1. If the pressure of the air is reduced, the timing must be advanced to compensate for the slower acting cylinder.

From the foregoing, it will be observed that numerous modifications and variations can be effected without departing from the spirit and scope of the novel concept of the present invention. It is to be understood that no limitation with respect to the specific embodiments disclosed herein is intended or should be inferred. The disclosure is intended to cover by the appended claims all such modifications as fall within the scope of the claim.

The invention claimed is:

1. A method of indexing a roll, comprising the steps of:

providing a rocking device having an axis of rotation;

connecting said axis of rotation to rotate said roll when said rocking device is pivoted in a first direction, and disconnecting said axis of rotation from said roll when said rocking device is pivoted in a second direction;

braking rotation of said roll when said rocking device is rotated an angular amount in said second direction;

applying a first force to said rocking device at a position on said rocking device eccentric to said axis of rotation to rotate said rocking device in the first direction to rotate the roll a predetermined amount, and then applying a second force in a reverse direction to said first force, to rotate said rocking device in said second direction to brake said roll.

2. The method according to claim 1, comprising the further step of, while said roll is being braked applying a heat sealing head to an article held on said roll.

3. The method according to claim 1, wherein said step of connecting said axis of said rocking device to said roll is further defined in that a drive pulley and a one-way clutch are provided and mounted concentrically on said axis of rotation of said rocking device, said drive pulley being mechanically connected to rotate said roll, said one-way clutch allowing common rotation between said rocking device and said drive pulley in said first direction, and free wheeling of said rocking device in said second direction; and said step of braking said roll is further defined in that said rocking device includes a brake portion mounted thereon at a distance from said common axis and adjacent an engagement surface of said drive pulley for engagement therewith to brake said drive pulley.

4. The method according to claim 3, wherein said step of connecting said axis of rotation of said rocking device to said roll is further defined in that a driven pulley is provided connected on a axis of said roll for rotation therewith, and further including a drive belt wrapped around said driven pulley and said drive pulley; and said step of braking said roll is further defined in that said brake portion mounted on said rocking device exerts a frictional force against said drive belt.

5. An indexing apparatus for repetitively turning a seal roll which is arranged in opposition to a heat seal head element, comprising:

a drive pulley;

a roll pulley connected to the seal roll to turn the seal roll when rotated;

a drive belt wrapped around said drive pulley and said seal roll pulley;

a rocker mounted flushly to said drive pulley and having a common axis of rotation therewith;

an actuator having an output portion connected to said rocker at a distance from said common axis, said output portion movable by said actuator to selectively pivot said rocker about said common axis in opposite rotary directions selectively; and a clutch connected between said rocker and said drive pulley to transmit rotary force from said rocker to said drive pulley only in one direction of said two opposite rotary directions.

6. The indexing apparatus according to claim 1, further comprising a brake member connected to said rocker at a distance from said common axis and deployed adjacent a brake position on said drive belt; and a stop arranged on an opposite side of said drive belt than said brake portion at said brake position, wherein pivoting of said rocker in an opposite direction to said one direction clamps said brake portion and said stop against said drive belt at said brake position.

7. The indexing apparatus according to claim 6, wherein said actuator comprises a pneumatic linear positioner, and said output portion comprises an output shaft extendable linearly from said pneumatic linear positioner, and said output shaft is connected to said rocker arm with a pivot connection.

8. The indexing apparatus according to claim 1, wherein said actuator comprises a pneumatic linear positioner, and said output portion comprises an output shaft extendable linearly from said pneumatic linear positioner, and said output shaft is connected to said rocker arm with a pivot connection.

9. An apparatus for indexing the rotation of a roll, comprising:

a drive pulley connected to the roll to rotate therewith;

a rocker mounted for rotation on a common axis with said drive pulley, said rocker having a connection portion extending a distance from said common axis, and a brake portion located at a second distance from said common axis;

a clutch interposed between said rocker and said drive pulley on said axis and operable to permit said rocker to drive said drive pulley in one rotary direction and allowing free rotation of said rocker from said drive pulley in an opposite direction of rotation;

a position actuator connected to said connection portion of said rocker and operable to move said connection portion to rotate said rocker about said common axis in both said one direction and said opposite direction; and an engagement surface movable with movement of said drive pulley and engagable by said brake portion to seize rotation of said drive pulley when said rocker is rotated an angular amount in said opposite direction.

10. The indexing apparatus according to claim 9, further comprising a drive belt and a driven pulley, said driven pulley connected to said roll and said drive belt wrapped around said drive pulley and said driven pulley; and said engagement surface is provided by a surface on said drive belt.

11. The indexing apparatus according to claim 10, wherein said actuator comprises a linear position device having an output shaft connected to said connection portion and selectively driven by fluid pressure.

12. The device according to claim 10, further comprising a stop arranged on an opposite side of said drive belt than said brake portion, said brake portion clamping said belt against said stop when said rocker is rotated an angular amount in said opposite direction.

13. The apparatus according to claim 10, wherein said clutch comprises a mechanical overrunning clutch.

* * * * *